United States Patent [19]

Plumer et al.

[11] 4,270,293

[45] Jun. 2, 1981

[54] DEVICE FOR LAUNCHING NON-LETHAL RING AIRFOIL PROJECTILES

[75] Inventors: Roy D. Plumer, Santa Barbara, Calif.; Donald N. Olson, Lutherville, Md.

[73] Assignee: The United States of America as represented by the Secretary of the Army, Washington, D.C.

[21] Appl. No.: 27,438

[22] Filed: Apr. 5, 1979

[51] Int. Cl.[3] ..... F41C 27/06

[52] U.S. Cl. ..... 42/1 F

[58] Field of Search ..... 42/1 F; 102/DIG. 10

[56] References Cited

U.S. PATENT DOCUMENTS

| | | | |
|---|---|---|---|
| 215,392 | 5/1879 | Plumb | 42/1 F |
| 2,499,379 | 3/1950 | Garrett | 42/1 F |
| 3,956,844 | 5/1976 | Misevich et al. | 102/DIG. 10 |
| 3,980,023 | 9/1976 | Misevich | 42/1 F |
| 3,981,093 | 9/1976 | Reed | 42/1 F |
| 4,154,012 | 5/1979 | Miller | 42/1 F |

OTHER PUBLICATIONS

*Army Research and Development News Magazine*; "Army Unveils Nonlethal RAG Projectiles", p. 4, Nov.-Dec. 1974.

*Primary Examiner*—Charles T. Jordan

*Attorney, Agent, or Firm*—Nathan Edelberg; Robert P. Gibson; A. Victor Erkkila

[57] ABSTRACT

A sabot launching device attachable to the muzzle of a standard rifle for launching a non-lethal ring airfoil projectile at a desired velocity and for imparting a desired rate of spin to the projectile, the invention comprises a housing having rifle grooves formed proximous to an open distal end thereof for imparting spin to the projectile as said projectile is launched from the open end of the housing. A sabot member engages the projectile within the housing prior to launch and is projected forwardly within the housing while in engagement with the projectile under pressure produced by firing of a gas-producing round in the standard rifle. The forward movement of the sabot member is rapidly slowed by a buffer mechanism disposed within anterior portions of the housing after initial acceleration to cause only the projectiles to exit and thus be launched from the housing, the sabot member thereby remaining within the housing and being reusable. The launching device is particularly useful for momentarily disabling disorderly persons without causing them serious injury, such as is necessary during civil disturbances and similar situations.

10 Claims, 5 Drawing Figures

DEVICE FOR LAUNCHING NON-LETHAL RING AIRFOIL PROJECTILES

STATEMENT OF GOVERNMENT INTEREST

The invention described herein may be manufactured, used and licensed by or for the Government for Governmental purposes without the payment to us of any royalties thereon.

BACKGROUND OF THE INVENTION

1. Field of the Invention

The invention relates generally to projectile launchers and particularly to launchers attachable to the muzzle of a standard rifle for launching non-lethal ring airfoil projectiles such as projected from such launchers by means of a sabot member. The invention thus relates to non-lethal weaponry useful for crowd control during civil disturbances, riots, and the like.

2. Description of the Prior Art

Flatau in U.S. Pat. No. 3,877,383 discloses the launching of annular projectiles from a launching device which utilizes a sabot member to engage and protect the projectile. It is adapted for use in crowd control situations and is capable of causing serious injuries due to the fact that the single member itself is ejected from the launching device.

In U.S. Pat. No. 3,919,799, Austin et al discloses a launching device for firing an annular grenade. The launching device including a sabot member provided with a plurality of circumferentially spaced peripheral cuts which permit fragmentation of this sabot member on exit from the launching device. However, the sabot member of Austin et al is not reusable since the sabot member is actually launched from the launching device and is caused to destruct upon exit from the launching device.

The prior art has not provided a suitable device for launching non-lethal ring airfoil projectiles, which devices are characterized by the use of a sabot member which is not projected from the launching device and is reusable. Annular projectiles which have at least in large measurement been found suitable for use in riot control situations are the non-lethal Soft RAG disclosed in co-pending U.S. Patent application Ser. No. 310,626 filed Nov. 29, 1972, issued as U.S. Pat. No. 3,898,932, this projectile containing a riot control agent payload and the non-lethal kinetic energy Sting RAG disclosed in co-pending U.S. Patent application Ser. No. 310,625 filed Nov. 29, 1972, issued as U.S. Pat. No. 3,982,489.

Further, an improved ring airfoil projectile of annular configuration which requires launching through use of a sabot member is disclosed in co-pending U.S. Patent application Ser. No. 006,326, filed Jan. 25, 1979, this improved projectile being invented by Donald N. Olson.

The projectiles referred to are intended to deter disorderly and riotous individuals, such individuals being commonly encountered during civil disturbances, without causing serious or permanent injury. The annular shape of these projectiles and the relatively fragile nature thereof necessitates the use of a close-fitting sabot member disposed about the projectile during launch, thereby to protect the projectile from the substantial forces encountered during launch thereof.

Sabot structures previously employed, however, actually exit from the launching device and separate from the launched projectile after exit from said launching device, with sabot fragments being projected down range and being capable of causing serious injury to persons struck thereby.

Since a need exists to launch non-lethal projectiles for the purposes indicated above, it is necessary to provide a launching device capable of launching non-lethal annular ring projectiles without damage to the projectile and without projecting fragments of potentially injurious material down range with the projectile.

Accordingly, the present invention provides a launching device for launching of ring airfoil type projectiles and without projecting potentially injurious fragments of a sabot member from the launching device.

SUMMARY OF THE INVENTION

The present invention provides a device capable of launching a non-lethal ring airfoil projectile without damage to the projectile and without projecting fragmentary material down range with the projectile, the present launching device being capable of attachment to the muzzle of a standard rifle such that the gases produced by a blank cartridge fired by said rifle can be employed to propel the projectile from the launching device. Ring airfoil projectiles which are to be launched from the present launching device are substantially surrounded by a reusable sabot member disposed within the launching device, the sabot member closely fitting about the relatively fragile projectile and moving forwardly within the launching device with the projectile due to pressure caused by expanding gases produced by firing of a blank cartridge in the rifle on which the launching device is mounted.

The forward movement within the launching device of the present sabot member is damped rapidly by a buffer mechanism disposed within anterior portions of the launching device, forward movement of the sabot member being completely stopped prior to exit of the sabot member from the exit end of the launching device. Accordingly, the ring airfoil projectile loosely held by the sabot member is caused to continue due to momentum on a path exiting from the launching device, the projectile continuing down range toward a target while the sabot member is retained within the lauching device for reuse. Accordingly, the sabot member of the present launching device does not exit the launching device and is thereby incapable of causing injury to persons down range of the launching device.

The present launching device is particularly adapted to fit the muzzle end of an M16A1 rifle and to be operated by the rifle, the expanding gases being ducted into the present launching device to propel the sabot member and the projectile forwardly within said launching device. The expanding gases act against rearward portions of the sabot member and do not directly contact the relatively fragile projectile. A desired spin rate is imparted to the projectile due to the provisions of rifled grooves disposed near exit portions of the launching device.

The present launching device comprises a housing having an open exit end, a sabot member being disposed within the housing and facing toward the exit end thereof. The substantially cylindrical sabot member is open at the outward end and has an interior cup-like platform disposed centrally within the interior thereof. An annular recess adapted to receive an annular ring airfoil projectile thereinto is defined between the cup-like platform and interior surface of the body of the sabot member. The sabot member has an actuating piston rod attached to rearward surfaces thereof, the rod extending backwardly of the major portions of the sabot member and through a central aperture formed longitudinally of a buffer mechanism located within central portions of the housing. The piston rod extends through said buffer mechanism and is provided with a pressure plate affixed to the end of said actuating rod opposite the sabot member.

Discharge gases generated by the firing of a blank cartridge within a standard rifle to which the present launching device is attached are ducted into an annular chamber located within a portion of the chamber in which the sabot member is disposed, the projectile held thereby to be projected forwardly within the housing toward the exit end thereof.

In order to prevent the sabot member from being launched through the exit end of the housing, the sabot member itself is decelerated within a short distance on impact between the pressure plate disposed at the interior end of the actuating piston rod and the buffer mechanism disposed within the interior of the housing, the pressure plate abutting the buffer mechanism and being subjected to a control resistance.

The sabot member itself is thus decelerated without decreasing the momentum of the projectile, the projectile thereby continuing along a path leading from the exit end of the housing, all portions of the projectile having been subjected to substantially equal forces at the time of launch such that the relatively fragile structure of the projectile is not damaged prior to contact with an intended target.

It is therefore an object of the invention to provide a launching device capbable of being mounted to a standard rifle and being capable of launching a non-lethal ring airfoil projectile at a desired velocity and spin rate, propulsive forces being generated by a blank cartridge fired by the rifle and acting against a sabot member which launches the projectile from the launching device without itself exiting said device.

It is another object of the present invention to provide a device for launching a non-lethal projectile without projecting hazardous materials down range of the launching device.

It is another object of the present invention to provide a device for launching relatively fragile non-lethal ring airfoil projectiles through the use of a sabot member which does not itself exit the launching device and thereby does not constitute a hazard to persons down range of the launching device.

It is yet another object of the present invention to provide a device for launching projectiles of a relatively fragile nature which must be held substantially within a sabot member during impartation of propulsive forces to the projectile, with the present sabot member being particularly reusable.

Other advantages of the invention will become more readily apparent in light of the following detailed description of the preferred embodiment of the invention.

DESCRIPTION OF THE PREFERRED EMBODIMENT

Figure 1:
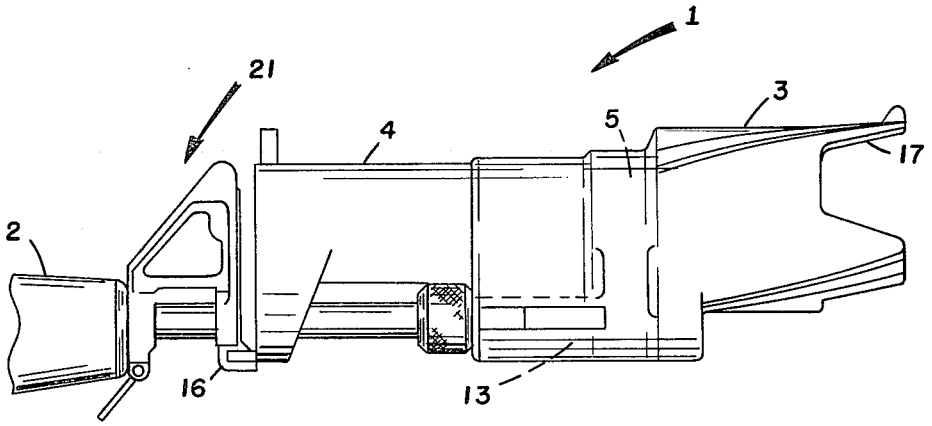
FIG. 1 is an elevational view illustrating the present launching device mounted to the muzzle of a M16A1 rifle.
Figure 2:
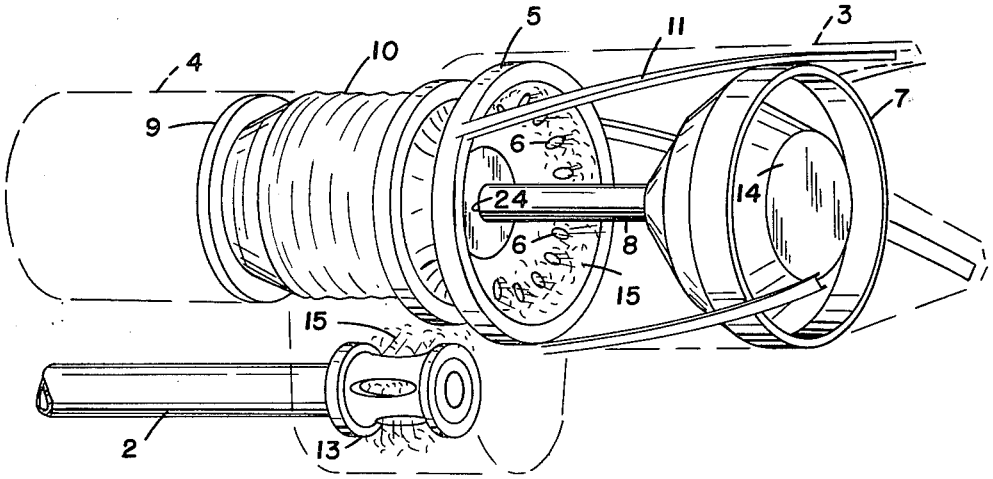
FIG. 2 is an idealized perspective view illustrating the functional relationship of certain internal components of the launching device with the muzzle of the rifle to which the launching device is attached, exterior outlines of the present launching device being particularly shown in phantom.
Figure 3:
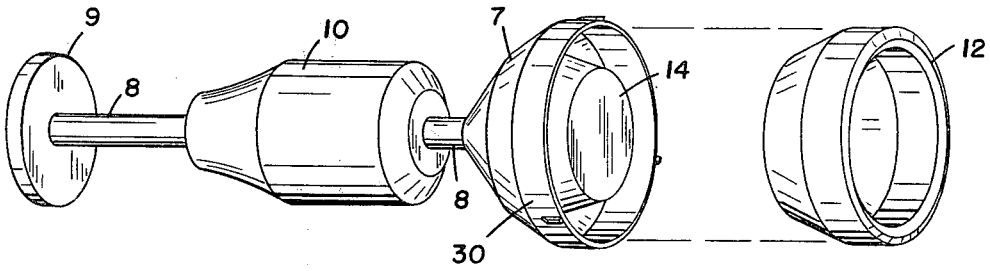
FIG. 3 is a perspective view of the sabot member and buffer mechanism of the present invention, a projectile launchable thereby being illustrated in a manner to show the fitting thereof within the sabot member.
Figure 4:
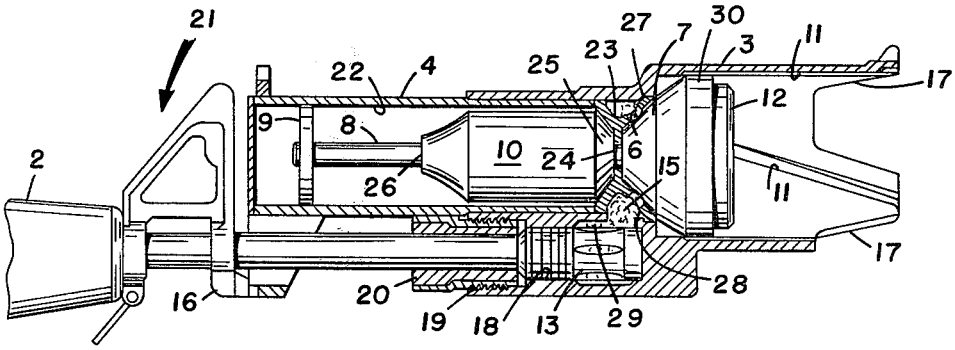
FIG. 4 is a side elevational view in partial section illustrating the present launching device in a firing confirmation.
Figure 5:
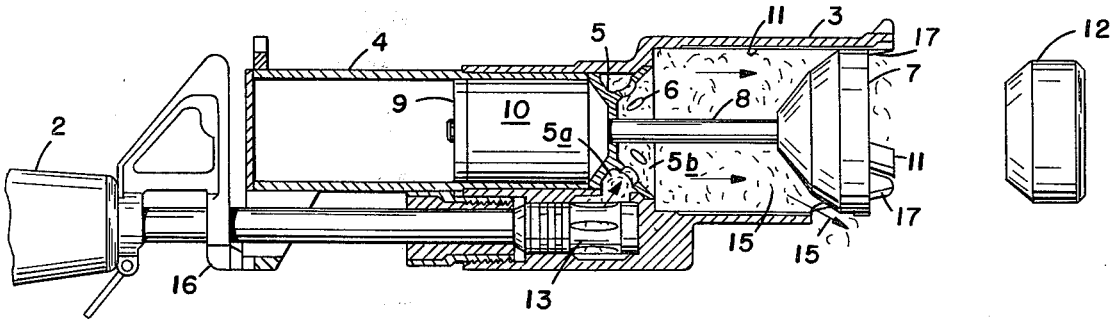
FIG. 5 is a side elevational view in partial section illustrating the present launching device immediately after launch of a projectile therefrom.

Referring now to the drawings, a launching device capble of launching non-lethal ring airfoil projectiles is seen generally at 1 to comprise a barrel section 3, an aft section 4, and a manifold section 5 disposed between the sections 3 and 4. The launching device 1 is seen particularly to be attachable to the barrel of a rifle 2 over the muzzle therof, distal end portions of the barrel of the rifle 2 including a flash suppressor 13 being receivable within a channel 18 which receives the flash suppressor 13 and free end of the rifle barrel thereinto. Threaded outer portions of the channel 18 mate with a threaded sleeve member 20 which fits over the barrel of the rifle 2 rearwardly of the flash suppressor 13 to mount the free end of the rifle barrel within the channel 18. The channel 18 is seen to be formed within solid lower portions of the manifold section 5. The launching device 1 is further seen to include an attachment structure 21 connected to rearmost portions of the aft section 4, the attachment structure 21 being adapted to engage with bayonet lug 16 of the rifle 2, thereby to provide positive attachment of the launching device 1 to the rifle 2.

The aft section 4 and the manifold section 5 of the launching device 1 are substantially cylindrical in conformation and define a longitudinal chamber 22 therewithin. A concave wall 23 disposed forwardly of the manifold section 5 defining the chamber 22 at forwardmost portions thereof, the concave wall 23 having an aperture 24 formed centrally therein. A buffer mechanism 10 is disposed substantially within the chamber 22 at the forwardmost portions thereof. The buffer mechanism 10 having a frusto-conical forward portion 25 which fits substantially flush. The aperture 24 in the concave wall 23 is aligned with a longitudinal channel 26 formed in the buffer mechanism 10. A piston rod 8 extends through the aperture 24 in the concave wall 23 and through the longitudinal channel 26 in the buffer mechanism 10, the interior end of the piston rod 8 extending freely into rearmost portions of the chamber 22. The piston rod 8 is provided with a pressure plate 9 affixed to the interior end thereof within said chamber 22, the pressure plate 9 being adapted to contact rearmost portions of the buffer mechanism 10 in a manner to be described hereinafter.

A convex wall 27 intersects or is formed integrally with the concave wall 23 forwardly of said wall 23 substantially within the interior of the manifold section 5 at the juncture between said manifold section 5 and the barrel section 3. An annular chamber 28 formed between the concave wall 23 and the convex wall 27 communicates with the channel 18 through an aperture 29. Expanding gases exiting the flash suppressor 13 of the rifle 2 fill the annular chamber 28 and pass through ports 6 disposed about the convex wall 27. The expanding gases directly contact rearmost portions of a sabot member 7 which is mounted within the barrel section 3 in direct contact with outer surfaces of the convex wall 27. The sabot member 7 is generally cup-like in conformation, the rearmost surfaces thereof being substantially conical and fitting flushly against the outer surfaces of the convex wall 27. The forwardmost portion of the sabot member 7 extends to a close-fitting relation with the interior of barrel section 3 which has rifling grooves 11 disposed on the interior cylindrical surfaces and project forwardly within the barrel section 3. Accordingly, expanding gases 15 entering the annular chamber 28 from the flash suppressor 13 of the rifle 2 are caused to contact rearmost portions of the sabot member 7 on passage of said gases through the ports 6 in the convex wall 27, the gases 15 expanding within the chamber defined by the convex wall 27 and the barrel section 3, thereby forcing the sabot member 7 forwardly within the barrel section 3 at a velocity of approximately 250 feet per second. During this acceleration, the sabot member 7 has a spin imparted thereto by the rifling grooves 11.

A projectile 12, which is intended to represent a nonlethal ring airfoil projectile such as is well known in the art, is held within the open end of the sabot member 7 and fits within an annular recess defined by exterior cylindrical portions of the sabot member 7 and a cup-like platform 14 which is centrally disposed within the sabot member 7. The projectile 12 is seen to have interior slanting surfaces disposed at the rearward portion thereof, the projectile 12 being open at both ends thereof. The opening within the projectile 12 at the rear end thereof thus fits over the cup-like platform 14 with the interior slanting surfaces of the projectile 12 fitting flushly with exterior slanting surfaces of the cup-like platform 14 of the sabot member 7. Exterior surfaces of the projectile 12 are similarly engaged and held between interior cylindrical surfaces of the sabot member 7. Therefore, the projectile 12 is engaged and held within the open-ended annular recess defined within the sabot member 7 between the cup-like platform 14 and interior surfaces of said sabot member 7.

The sabot member 7 is seen to be attached to the outermost end of the piston rod 8. On projection of the sabot member 7, the pressure plate 9 disposed on the opposite end of the piston rod 8 is caused to contact the rearmost end of the buffer mechanism 10. On engagement of the buffer mechanism 10 by the pressure plate 9, the energy imparted to the sabot member 8 is absorbed by said buffer mechanism 10.

The buffer mechanism 10 is preferably comprised of elastomer material formed in graduated or multistage spring fashion. Holes, grooves, or other easily molded voids allow buffer mechanism 10 to collase such that the voids formed therein provide an energy absorbing function similar to that of a collapsing spring.

The elastic nature of the material from which the buffer mechanism 10 is formed further provides a second spring function which further absorbs the kinetic energy imparted to the sabot member 7. Energy is further absorbed in the deceleration of the sabot member 7. The friction of the buffer materials against the interior walls of the manifold section 5 further acts to decelerate the sabot member 7 from a velocity of approximately 250 feet per second to a dead stop within a distance of less than 1 and ½ inches in a typical launching device fabricated according to the teachings of the present invention.

The sabot member 7 is thus stopped by the energy absorbing action of the pressure plate 9 on the buffer mechanism 10, thereby preventing the sabot member 7 itself from being projected from the exit end of the barrel section 3. However, the projectile 12 held by the sabot member 7 does not have its momentum damped by the buffer mecahnism 10 and thus proceeds toward a target at a given velocity and spin rate, which spin rate was imparted by the rifling grooves 11 in sabot launching device 1. The opening 17 at the forward end of the barrel section 3 allows venting of the propellant gases 15 on completion of the propelling function thereof.

The projectile 12 can therefore be launched from the launching device 1 at velocities of up to 300 feet per second and with spin rates exceeding 2,000 revolutions per minute.

Due to the protective effect exerted by the sabot member 7, the projectile 12 is shielded from unevenly applied propulsive forces and is therefore launched from the device 1 intact and without damage thereto. The sabot member 7 is instead subjected to the propulsive forces exerted by the expanding gases 15 and protects the projectile 12 from damage, the projectile 12 separating from the sabot member 7 on deceleration of said sabot member 7 as previously described.

The sabot member 7 does not itself exit the launching device 1 and is thereby reusable. Further, since the sabot member 7 does not exit the launching device, neither the sabot member 7 nor fragments thereof are caused to be projected down range with the projectile 12, such fragments being capable of causing serious injury to persons. The sabot member 7 can particularly be formed of A1S1 Type 304 Stainless Steel in order to impart a desired strength to weight ratio to the structure. A particularly high degree of stength is necessary in the fabrication of the sabot member 7 in order that the structure is enabled to accommodate the large loads imposed thereon by the expanding gases 15. On venting of the gases 15 from the barrel section 3, the sabot member 7 may be moved rearwardly within the barrel section 3 to a launch position and loaded with another projectile 12 for launch thereof. The buffer mechanism 10 similarly returns to a launch configuration due to the elasticity thereof.

As can be readily understood from the foregoing description of the preferred embodiment of the invention, the present launching device 1 can be configured other than as particularly described herein. It is therefore to be understood that modifications and variations of the invention are possible without departing from the scope of the invention as recited in the appended claims.

We claim:

1. A device for launching annular projectiles, which device is attachable to a rifle for firing with a blank cartridge, comprising:

a housing having an opening at one end thereof;

a sabot member open at one end and defining an annular recess for receiving the annular projectile substantially flushly thereinto, the sabot member being received within the housing, with the open end of said sabot member facing the open end of the housing;

a piston rod mounted at one end thereof to a closed rear portion of the sabot member, the piston rod extending longitudinally within the housing;

a pressure plate connected to the opposite end of the piston rod; energy absorbing means for said pressure plate; and means for directing expanding gases from firing to project said sabot member and projectile forwardly within the housing toward the open end of the housing, said pressure plate bearing against said energy absorbing means and thereby cushioning said sabot member in said housing, with the projectile maintaining the momentum imparted thereto on acceleration of the sabot member and thereby being projected from the open end of the housing.

2. The device of claim 1 wherein the housing comprises:

a barrel section;

a manifold section adjacent to said barrel section and connected thereto;

an aft section adjacent to said manifold section and connected thereto; and means for connecting said housing to said rifle.

3. The device of claim 2 wherein the sabot member comprises:

a cup-like body member configured to fit substantially flushly within the barrel section; and an inner cup-like platform member located centrally within said cup-like body member, an annular chamber being defined between the platform and inner surfaces of the body member for substantially flushly receiving the projectile thereinto.

4. The device of claim 2 and further comprising rifling grooves formed on inner wall surfaces of the barrel section to impart spin to the projectile.

5. The device of claim 2 and further comprising vents formed in the barrel section to permit venting of gases therefrom.

6. The device of claim 2 wherein the manifold section defines an interior annular chamber for receiving propulsion gases from the rifle, said chamber having ports formed in wall surfaces thereof to communicate the propulsion gases with the sabot member.

7. The device of claim 1 wherein the energy absorbing means comprises a buffer structure formed of elastic material and having a central channel formed therethrough, the central channel receiving portions of the piston rod therewithin.

8. The device of claim 1 wherein the last mentioned means comprises a lower body portion formed on the housing and having a channel formed therein for receiving the distal end of the barrel of the rifle thereinto, the channel connecting with the interior of the housing rearwardly adjacent to the sabot member to vent gases entering said channel into the housing.

9. The device of claim 1, and further comprising means for attaching the housing to the rifle.

10. The device of claim 9 wherein the last mentioned means comprises means for connecting the housing to a bayonet lug on a rifle.

* * * * *